US006727048B2

(12) United States Patent
Trollsas et al.

(10) Patent No.: US 6,727,048 B2
(45) Date of Patent: Apr. 27, 2004

(54) METHOD FOR PHOTO-IMAGEABLE LACQUER DEPOSITION FOR A DISPLAY DEVICE

(75) Inventors: Olof M. Trollsas, Los Gatos, CA (US); Theodore S. Fahlen, San Jose, CA (US)

(73) Assignees: Candescent Intellectual Property Services, Inc., Los Gatos, CA (US); Candescent Technologies Corporation, Los Gatos, CA (US)

( * ) Notice: Subject to any disclaimer, the term of this patent is extended or adjusted under 35 U.S.C. 154(b) by 0 days.

(21) Appl. No.: 10/028,043

(22) Filed: Dec. 20, 2001

(65) Prior Publication Data

US 2003/0224251 A1 Dec. 4, 2003

(51) Int. Cl.[7] ..... B05D 5/00; G03C 5/00

(52) U.S. Cl. ..... 430/322; 430/324; 430/330; 430/26; 430/25; 313/496; 313/495; 427/68; 427/71

(58) Field of Search ..... 430/322–324, 430/330, 26–25; 313/496, 495; 427/68–71

(56) References Cited

U.S. PATENT DOCUMENTS

| | | | | | |
|---|---|---|---|---|---|
| 3,603,830 | A | * | 9/1971 | Gallaro et al. | 313/473 |
| 5,470,681 | A | * | 11/1995 | Brunner et al. | 430/5 |
| 6,022,652 | A | * | 2/2000 | Haven et al. | 430/26 |
| 2002/0190643 | A1 | * | 12/2002 | Cummings et al. | 313/553 |

* cited by examiner

*Primary Examiner*—Mark F. Huff
*Assistant Examiner*—Daborah Chako-Davis

(57) ABSTRACT

A method for photo-imageable lacquer deposition for a display device. In one embodiment, a layer of photo-imageable lacquer is deposited on top of a faceplate of a display device. Portions of the lacquer layer are removed and selected portions of the lacquer layer remain deposited in the sub-pixel areas of the faceplate.

23 Claims, 13 Drawing Sheets

METHOD FOR PHOTO-IMAGEABLE LACQUER DEPOSITION FOR A DISPLAY DEVICE

FIELD OF THE INVENTION

The field of the invention relates to the manufacture of display devices. More specifically, the present invention pertains to producing a lacquer layer in the manufacture of display devices.

BACKGROUND OF THE INVENTION

For over 30 years, companies have searched for ways to construct a thin, low-power version of the conventional cathode ray tube (CRT). These efforts have led to a number of flat panel display technologies. None, including liquid crystal displays (LCDs) have met all of the needs for improved power, brightness, efficiency, video response, viewing angle, operating temperature, packaging, full color gamut, ruggedness, and scaleability.

Among the obstacles encountered in fabricating thin cathode ray displays is the deposition of a lacquer layer on the faceplate of the display prior to adding an aluminum layer. The aluminum layer is used to act as a mirror behind each sub-pixel in the display faceplate to reflect the light photons back toward the viewer of the display screen to create a brighter image. Surface irregularities in the aluminum layer scatter these photons and reduce the efficiency of the aluminum layer in reflecting light to the viewer, thus degrading the brightness of the display. The lacquer layer provides a supporting structure when the aluminum layer is deposited so that the aluminum layer is deposited upon an even surface and will reflect light evenly toward the viewer.

One method of depositing the lacquer layer is known as a "float lacquer" process. FIGS. 1A–C are cross section views showing the steps in a prior art float lacquer process. In FIG. 1A, a faceplate 101 is submerged in a solvent 102 such as water. In FIG. 1B, a thin layer of lacquer 103 is deposited or floated on top of water layer 102. The water is then drained from the tank and, as the water level subsides, lacquer layer 103 is deposited upon faceplate 101. In FIG. 1C, the level of water layer 102 in the sub-pixels 104 of faceplate 101 is then further reduced by evaporation and an aluminum layer is deposited directly on top of lacquer layer 103. If the aluminum layer were to be deposited directly upon the phosphor particles within sub-pixels 104, it would conform to the surface of the phosphor particles and have a very irregular surface which would reflect light back to the phosphor particles unevenly. During a subsequent baking operation, the remnants of lacquer layer 103 are removed as they can absorb electrons from the cathode and cause phosphor degradation if they remain.

The float lacquer process, however, is time consuming and is vulnerable to operator error. The amount of time it takes to set up the float tank and allow the water to become still enough to deposit lacquer layer 103 means the process is not well suited to larger scale manufacturing processes. Additionally, there can be variations in lacquer layer 103 as large as 30% using the float lacquer process, resulting in an irregular aluminum surface. This causes a non-uniform screen appearance and degrades the efficiency and brightness of the display.

The structure of thin CRTs limits the choice of lacquers in a float lacquer process to soft materials with very high elongation. High elongation is necessary to obtain a scaffold for the reflective aluminum to be applied without "tenting" over the sub-pixel regions. Tenting can be caused by an excessive amount of lacquer on the faceplate which makes the surface of the aluminum balloon and rupture when the lacquer and remaining water is baked out. Tenting can be detrimental, not only to the faceplate, but also during final assembly when support structures, inserted to provide greater structural integrity, can cause the aluminum layer to break which leads to electrical arcing in the finished display assembly. Tenting causes non-uniform screen appearance and reduced efficiency and brightness.

FIG. 2A shows an exemplary display screen 200 which has undergone aluminum layer deposition and solvent bake out. The surface of aluminum layer 250 overlies sub-pixel areas 203 containing phosphor particles 202. Aluminum layer 250 has undergone tenting in the sub-pixel regions during the bake out step and now has a convex surface profile from the viewers direction (the direction of arrow 260) rather than a flat surface. Due to the convex profile, light photons will now be scattered by the aluminum layer rather than directed to the viewer and the efficiency and brightness of the display are thus decreased.

Materials with high elongation are also soft materials, which means that the lacquer layer will be very conformal around the phosphor particles in the sub-pixels. In FIG. 2B, a highly conformal lacquer layer 201 has been deposited upon a layer of phosphor particles 202 contained in a sub-pixel 203. An aluminum layer deposited upon this lacquer layer will take on the shape of the conformal lacquer layer during the subsequent baking step to remove the lacquer layer and any remaining solvents. This causes the aluminum to also take on an irregular shape which reduces the reflectivity of the aluminum layer and can cause a grainy appearance in the display due to bad uniformity. To smooth the aluminum, a thicker lacquer layer (<1 $\mu$in thickness) is usually deposited on a regular CRT. Due the lower voltages used in a thin CRT, a thinner layer of aluminum is necessary to prevent excess electron energy loss. However, this thin aluminum layer is susceptible to blistering and breakage during the bake out if the lacquer layer is greater than 1 $\mu$in thickness. In summary, using a thin lacquer layer creates an excessively conformal aluminum layer and using a thicker lacquer layer leads to tenting and rupturing of the aluminum layer.

Accordingly, the need exists for a method for depositing a lacquer layer in the sub-pixel areas of a display device which will result in a smooth, highly reflective aluminum layer that is electrically and mechanically robust. It is also desirable that this method, while meeting the above stated needs, should be applicable to large scale manufacturing processes.

SUMMARY OF THE INVENTION

The present invention is a method for selectively removing a lacquer layer so that so that the remaining lacquer is disposed in the sub-pixel areas of a display device, resulting in a smooth, highly reflective aluminum layer that is electrically and mechanically robust. It is also desirable that this method, while meeting the above stated needs, should be applicable to large scale manufacturing processes.

In one embodiment, a layer of thermally degradable, photo-imageable lacquer is deposited on top of a faceplate of a display device. Portions of the lacquer layer are etched and removed using photolithography methods and selected portions of the lacquer layer remain deposited in the sub-pixel areas of the faceplate. This remaining layer will then later be decomposed thermally and degraded into volatile products that will disappear during subsequent vacuum processes.

In another embodiment, the faceplate of the display device is used as the mask for defining which portions of the photo-imageable lacquer layer remain in the sub-pixel areas. This has an added advantage in that a mask does not have to be created and aligned over the faceplate to image the lacquer layer.

These and other advantages of the present invention will become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the present invention and, together with the description, serve to explain the principles of the invention. Unless specifically noted, the drawings referred to in this description should be understood as not being drawn to scale.

DETAILED DESCRIPTION OF THE PREFERRED EMBODIMENT

Reference will now be made in detail to the preferred embodiments of the present invention, examples of which are illustrated in the accompanying drawings. While the present invention will be described in conjunction with the preferred embodiments, it will be understood that they are not intended to limit the present invention to these embodiments. On the contrary, the present invention is intended to cover alternatives, modifications, and equivalents, which may be included within the spirit and scope of the present invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1A:
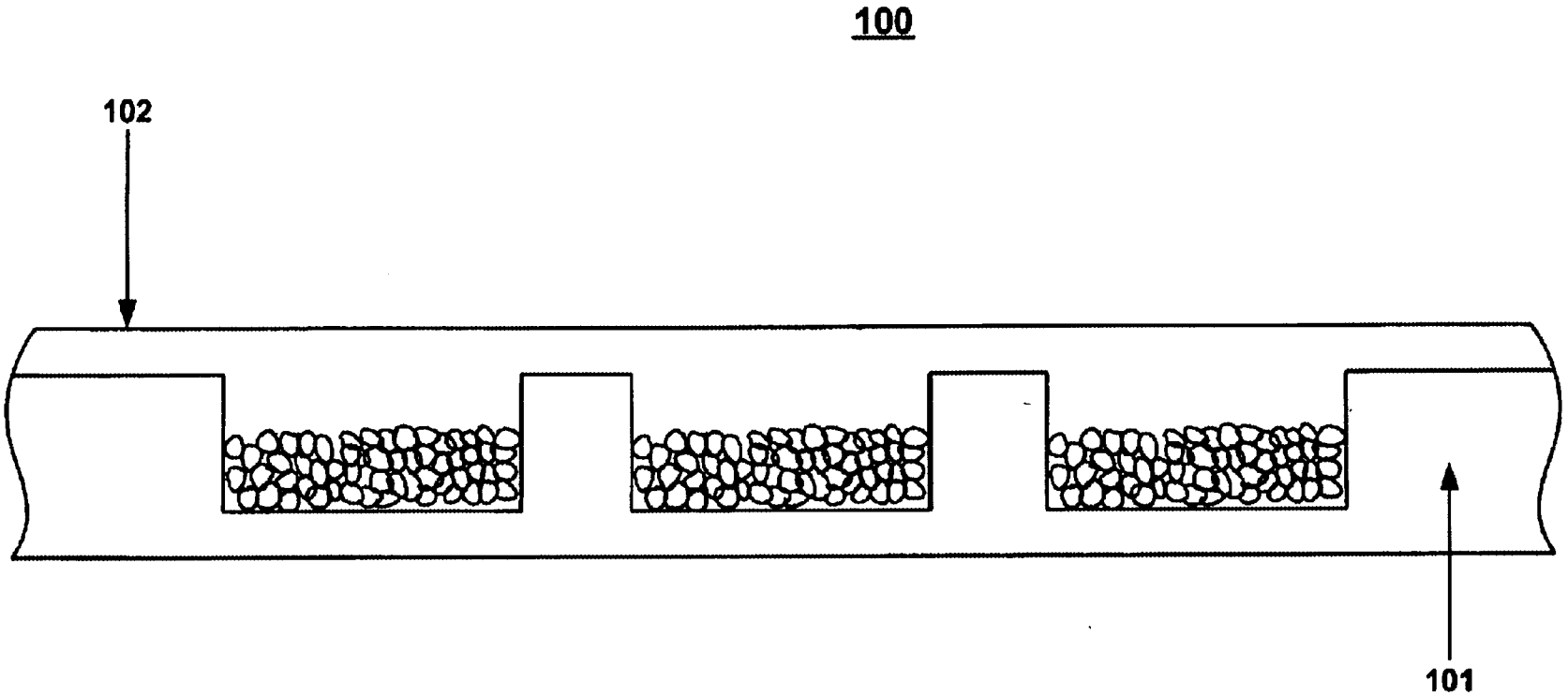
FIG. 1A (Prior Art)
FIGS. 1A–1C are cross section views of a display pixel area during a prior art lacquer layer deposition.
Figure 1B:
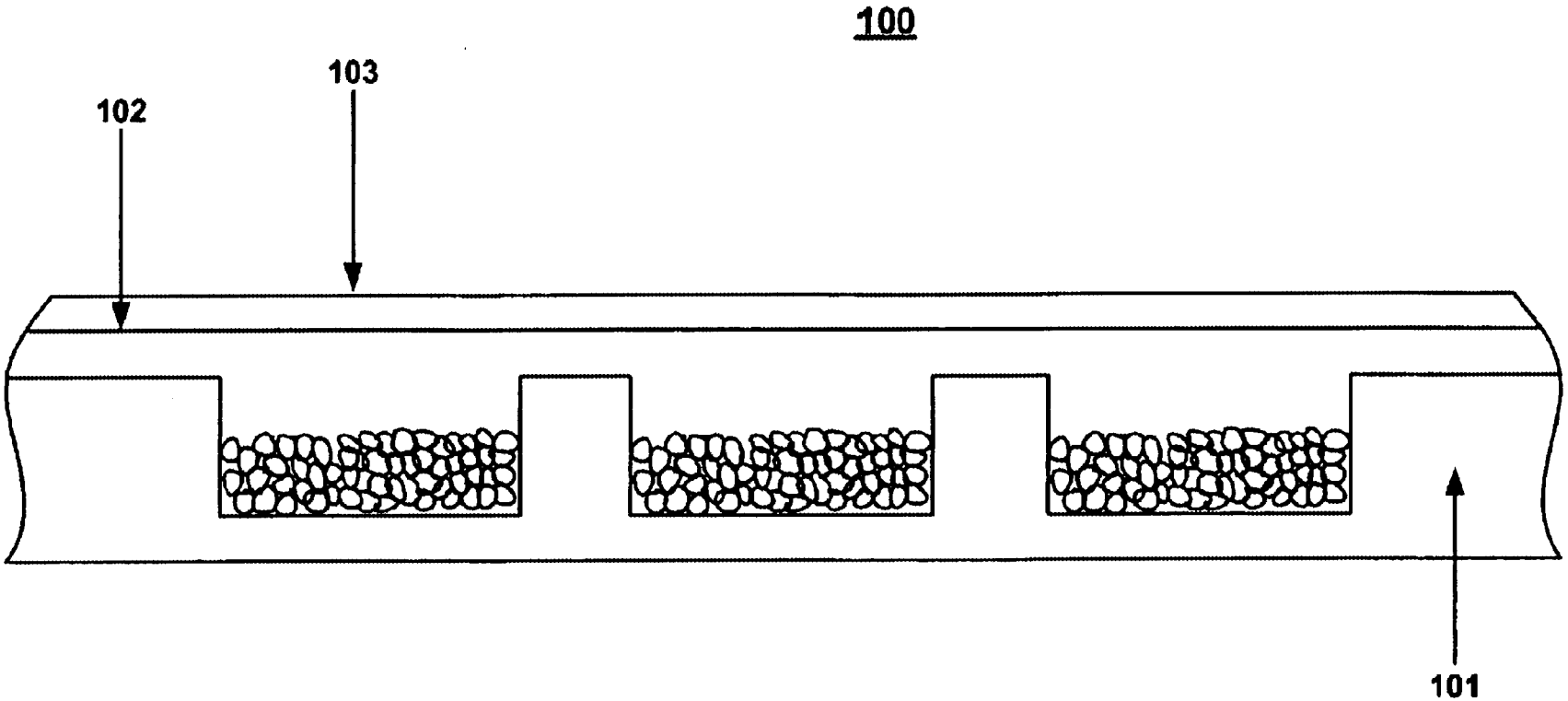
FIG. 1B (Prior Art)
Figure 1C:
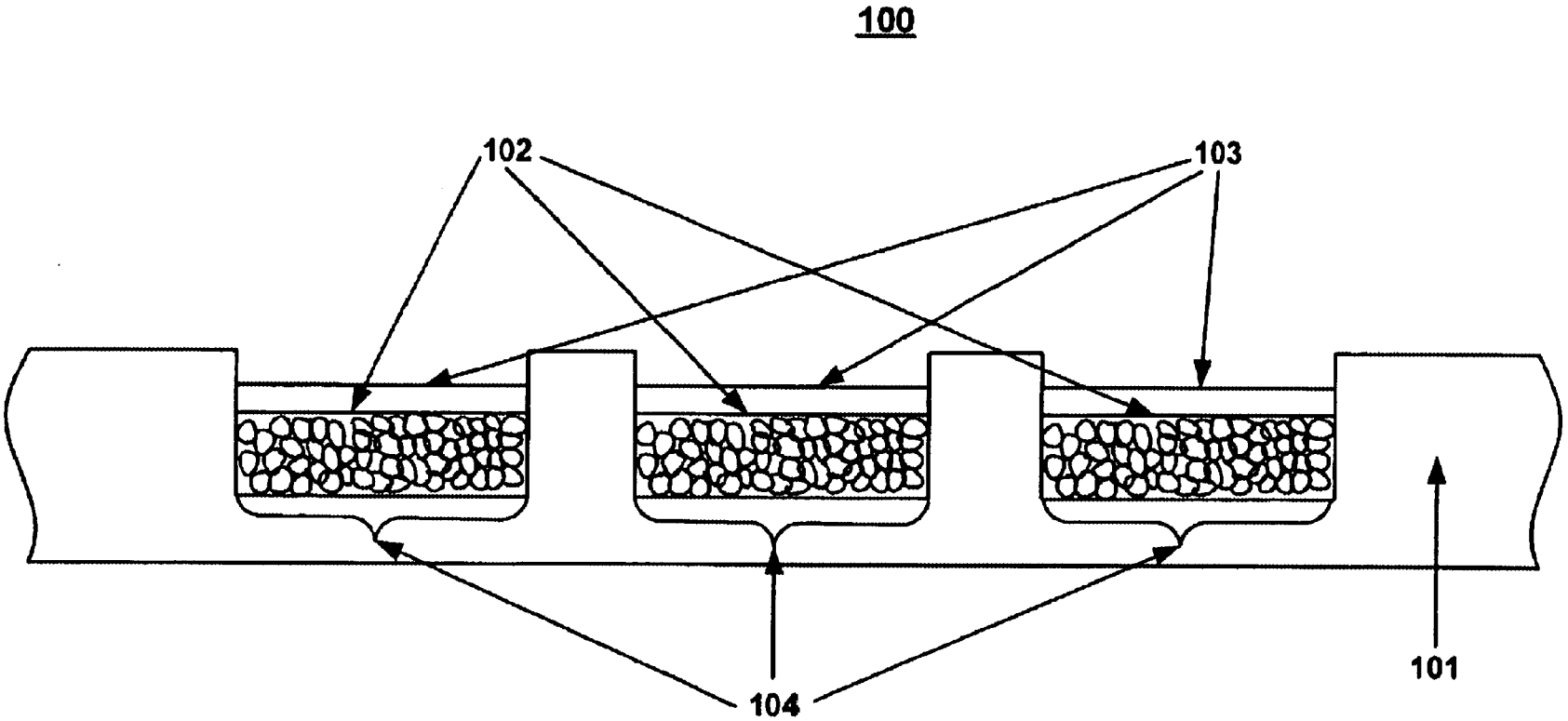
FIG. 1C (Prior Art)
Figure 2A:
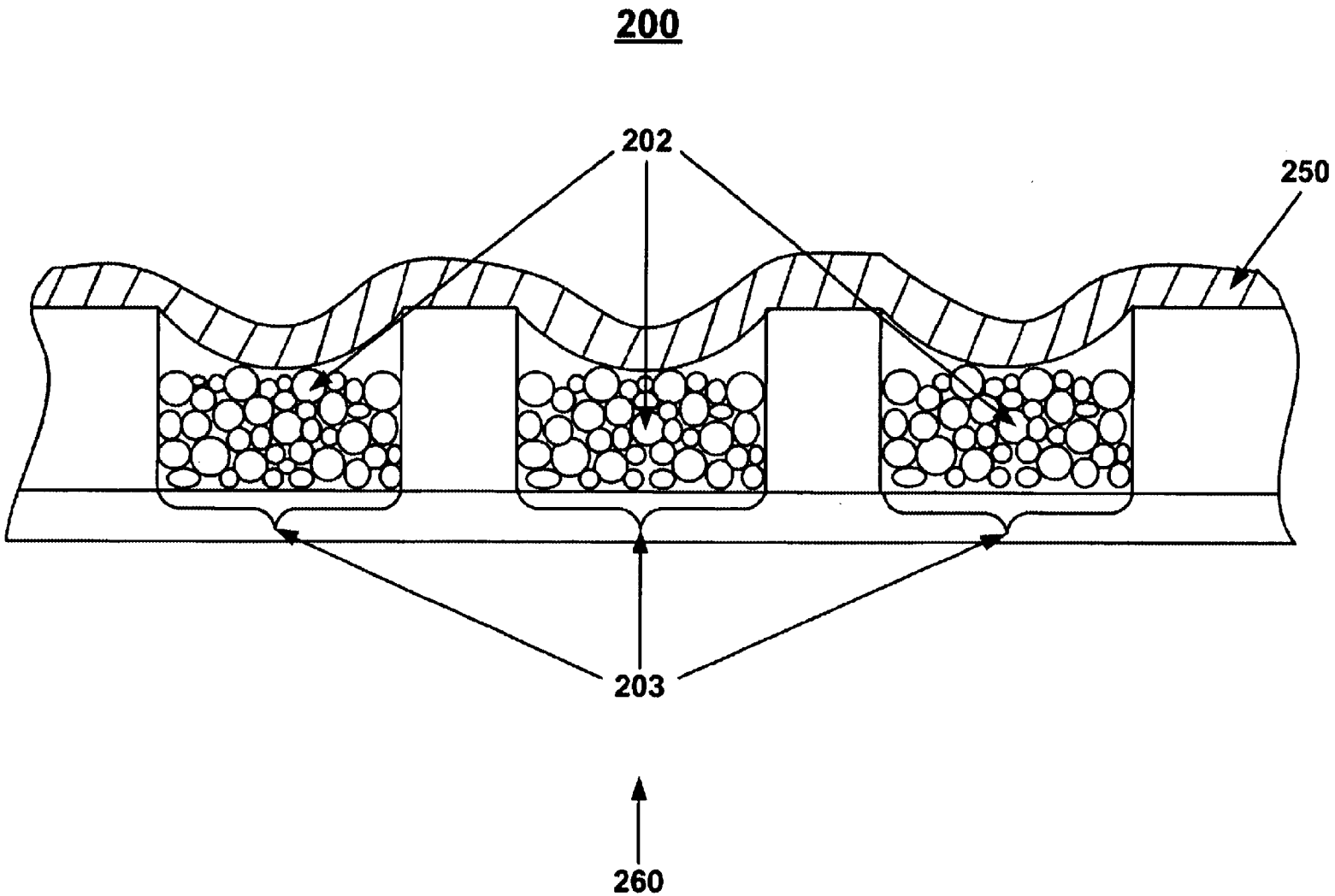
FIG. 2A (Prior Art)
FIGS. 2A–B are cross section views showing disadvantages in fabricating a display device using prior art lacquer deposition methods.
Figure 2B:
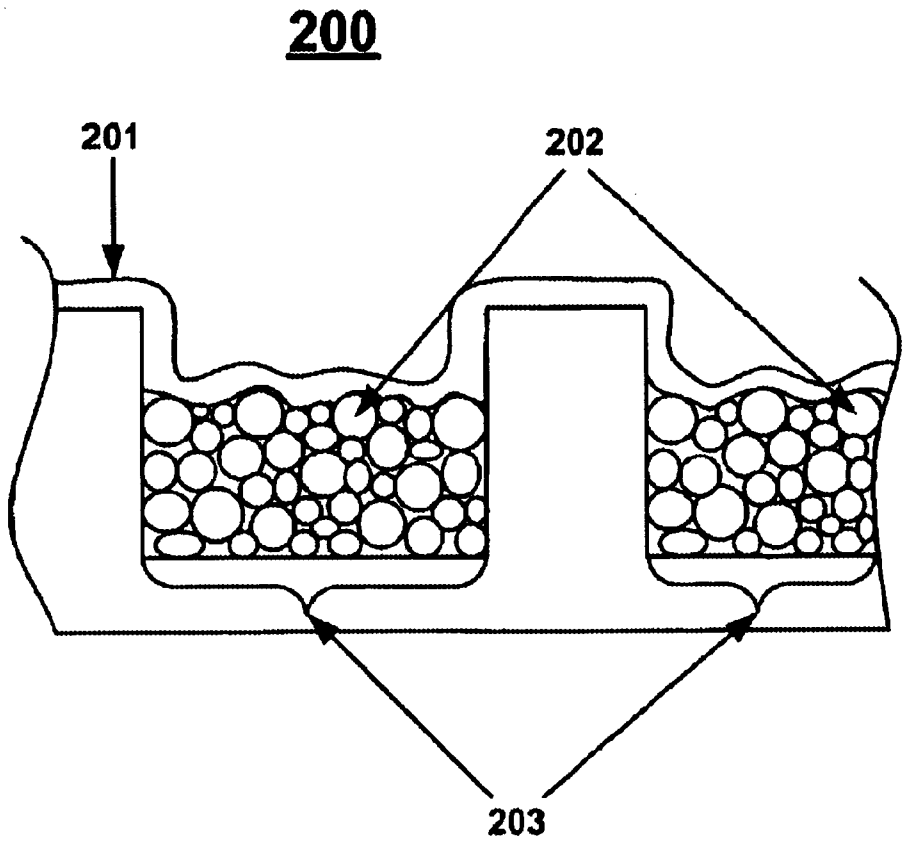
FIG. 2B (Prior Art)
Figure 3A:
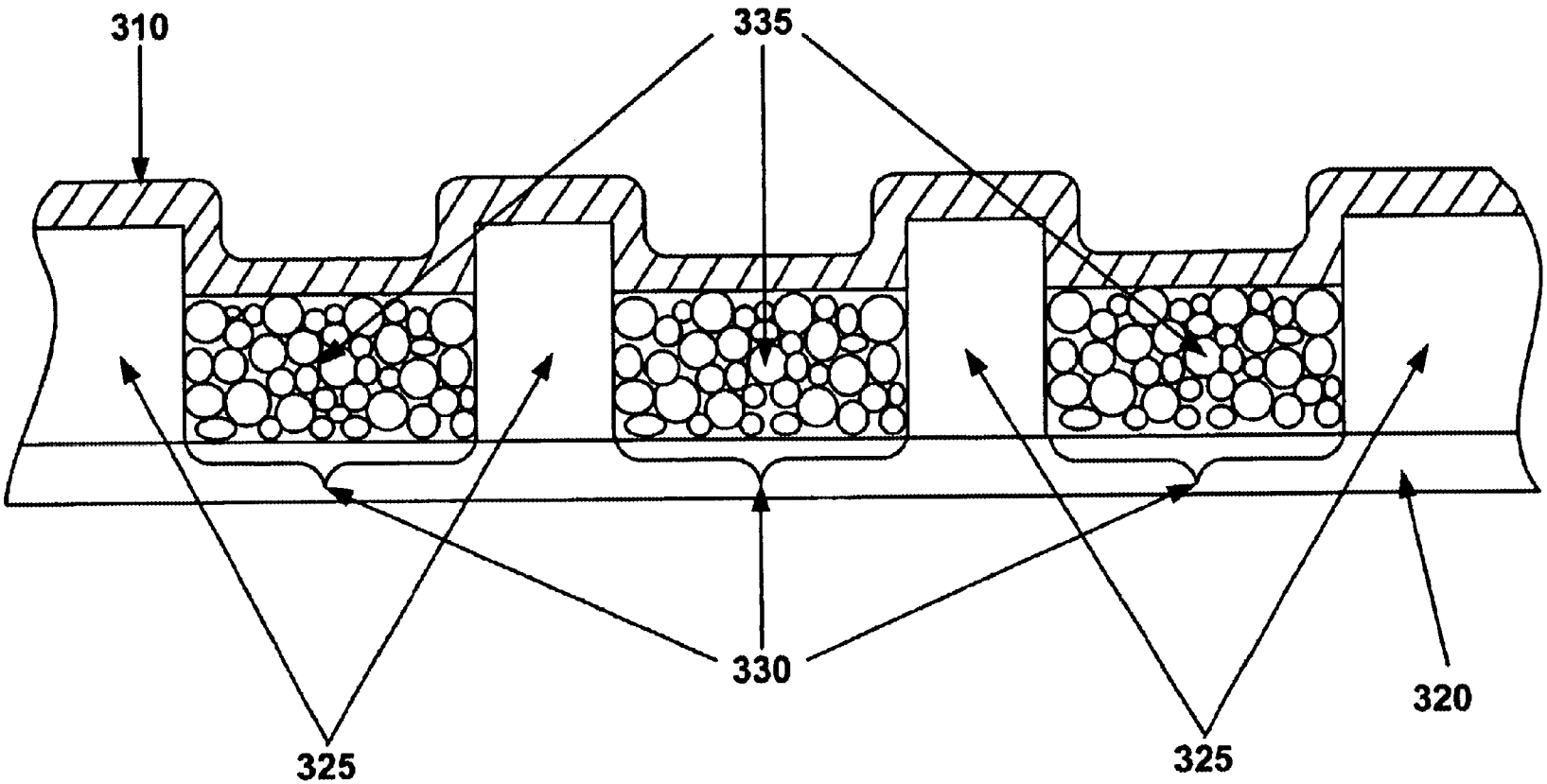
FIGS. 3A–3C are cross section views of a display pixel area during a lacquer layer deposition in accordance with embodiments of the present invention.
Figure 3B:
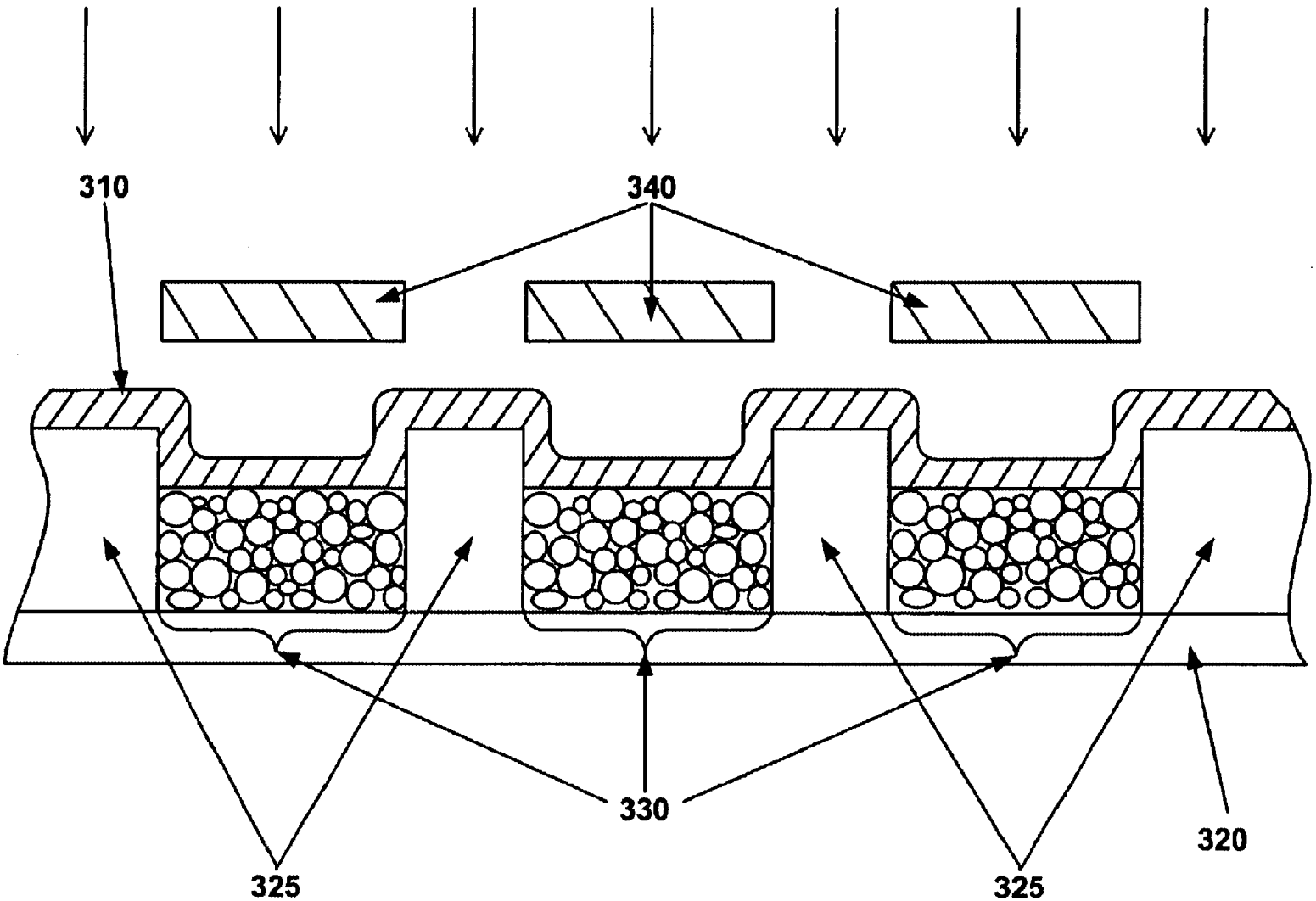
Figure 3C:
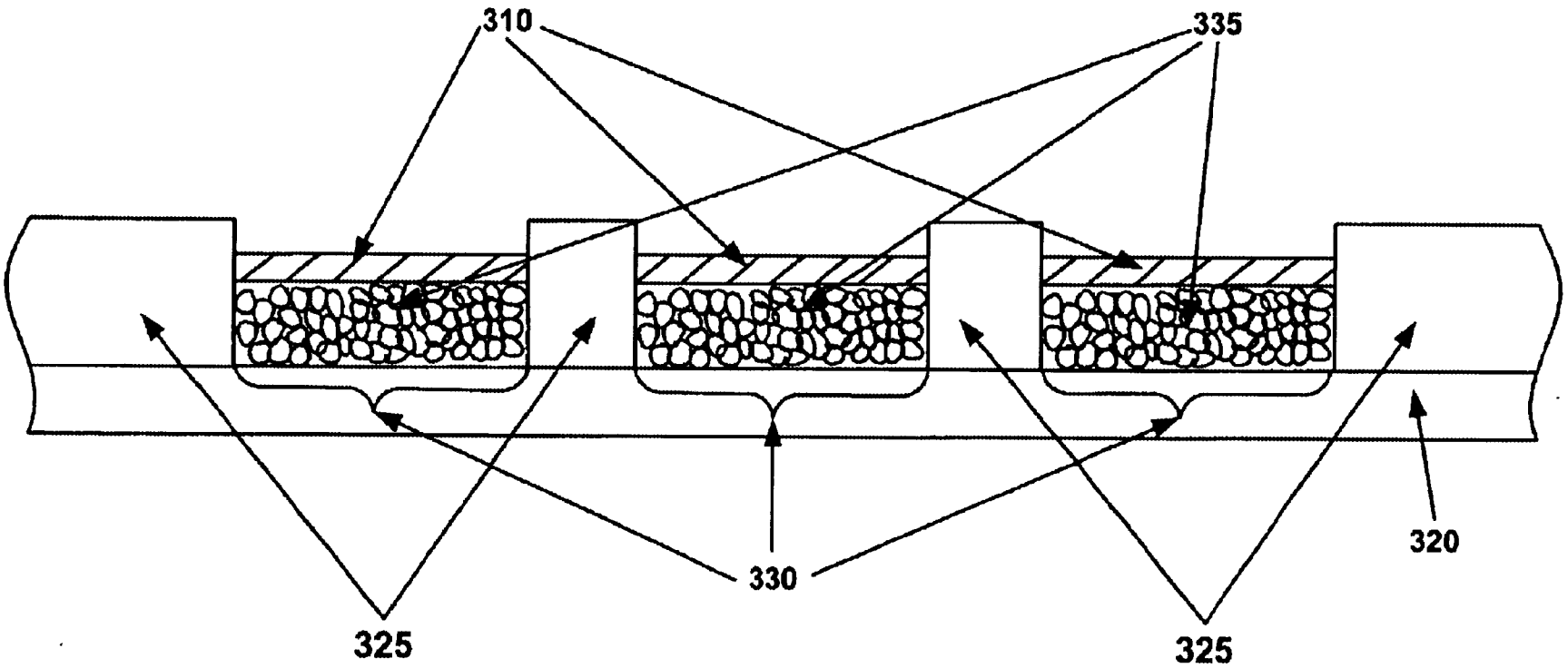
Figure 4:
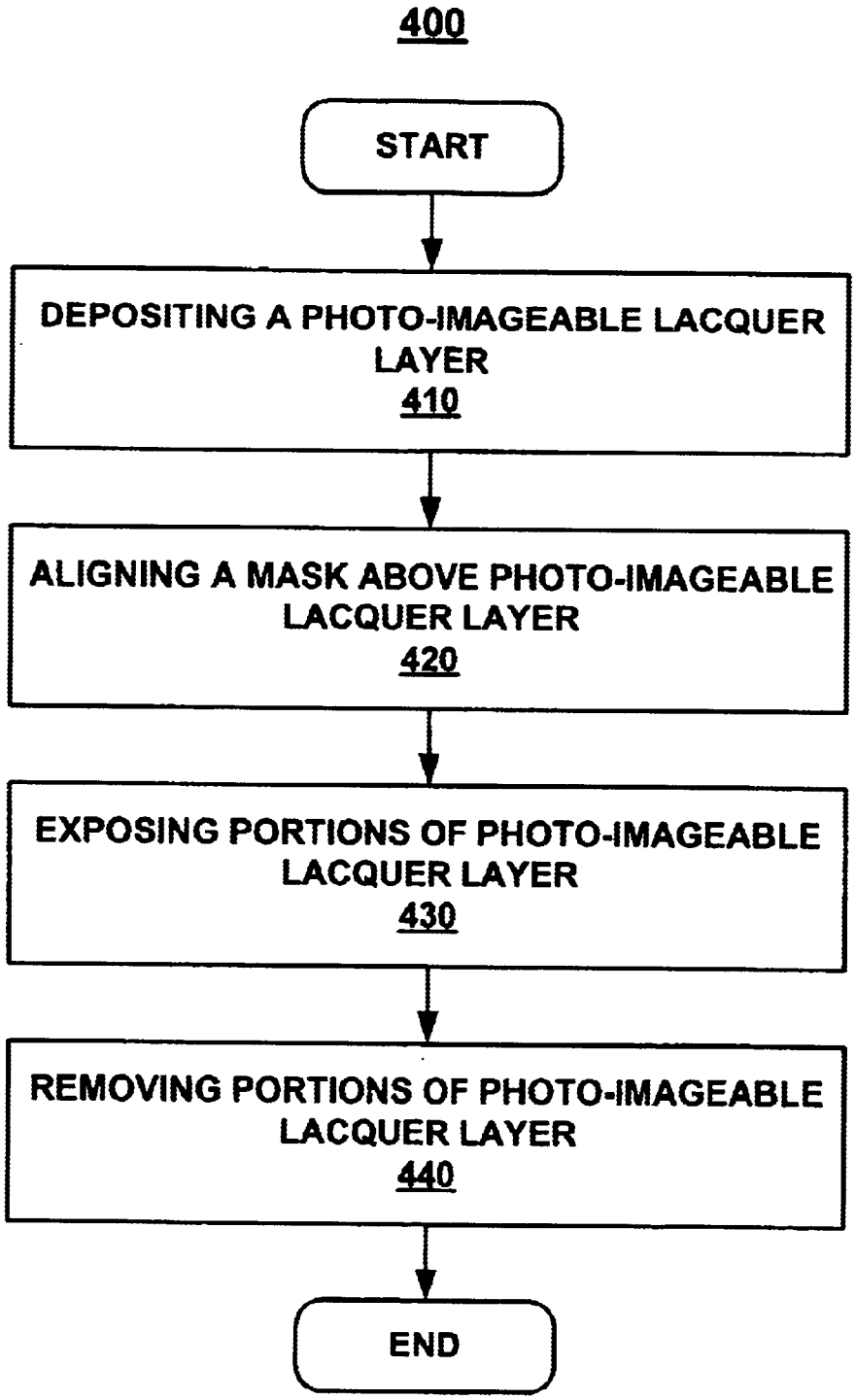
FIG. 4 is a flow chart of the steps involved in accordance with one embodiment of the present invention.

FIGS. 3A–3C are cross section views of a display pixel area during a lacquer layer deposition process as set forth in one embodiment of the current invention as set forth in flow chart 400 of FIG. 4. For purposes of clarity, the following discussion will utilize the cross section views of FIGS. 3A–3C in conjunction with flow chart 400 of FIG. 4, to clearly describe one embodiment of the present invention. As will be described in detail below, the present invention is a method for photo-imageable lacquer deposition for a display device.

With reference to FIG. 3A and to step 410 of FIG. 4, a photo-imageable lacquer layer 310 is deposited. Photo-imageable lacquer layer 310 is deposited upon a faceplate having a glass layer 320 and sub-pixel areas 330 which are separated by portions of a black matrix screen 325. The black matrix screen serves to provide an opaque contrasting background for the sub-pixels and results in a more defined image for the display device. Sub-pixel areas 330 contain the phosphor particles 335 of the display device. In the present embodiment, photo-imageable lacquer layer 310 is polymethyl methacrylate (positive resist). With a positive resist lacquer, the portions exposed to light are later removed. With a negative resist lacquer, the portions not exposed to light are later removed. While the present embodiment recites polymethyl methacrylate, the present invention is well suited to utilize a variety of positive and negative resist lacquers in photo-imageable lacquer layer 310.

Because the present invention does not use the float lacquer process, low elongation lacquers can be utilized. The advantage of utilizing a low elongation lacquer in the fabrication of a display device above the prior art is that a low elongation lacquer forms a less conformal layer upon the phosphor particles (e.g., phosphor particles 335) in sub-pixel areas 330 of faceplate 320. This means that a non-conformal lacquer layer can be deposited which is not so thick as to cause tenting and bursting in the aluminum layer. This leads to a more uniform aluminum layer which reflects light to the viewer more evenly and facilitates a brighter, more efficient display device. The float lacquer method relies upon high elongation lacquers which form a much more conformal lacquer layer and create an aluminum layer which reflects light photons less efficiently back toward the viewer.

Photo-imageable lacquer layer 310 may be deposited by spray deposition, spin deposition, printing, and extrusion. While the present embodiment recites these specific deposition methods, the present invention is well suited to utilize other methods to deposit photo-imageable lacquer layer 310. Photo-imageable lacquer layer 310 is deposited in a blanket deposition upon faceplate 320. After being deposited upon faceplate 320, photo-imageable lacquer layer 310 is dried.

The present invention is much quicker than the float lacquer process and more suitable for large scale manufacturing processes. One of the greatest disadvantages of using a float lacquer process is that excessive time is lost in waiting for the water in the tank to become still and flat prior to depositing the lacquer layer. This makes the float lacquer process time consuming, economically inefficient, and unsuited to large scale manufacturing processes. If the water is not allowed to become still, the lacquer layer will be of non-uniform thickness which can cause an irregular aluminum layer. Because photo-imageable lacquer layer 310 is not deposited using the float lacquer process, the present invention does not require this wait and is more applicable to large scale manufacturing processes.

With reference to FIG. 3B and to step 420 of FIG. 4, a mask (e.g., pattern mask 340) is aligned above photo-imageable lacquer layer 310. Mask 340 has openings in it that cover sub-pixel areas 330. Alternatively, a mask may be created with openings in the areas corresponding with sub-pixel areas 330.

Photolithography techniques are often used in the fabrication of semiconductor structures. In one photolithography process, a pattern mask (e.g., pattern mask 340 of FIG. 4) that defines the size and shape of a component in a semiconductor structure is positioned above a photosensitive layer (e.g., photo-imageable lacquer layer 310) that has been applied over a layer of material. In one embodiment of the present invention, pattern mask 340 has openings which define the sub-pixel areas 330 of faceplate 320. However, pattern mask 340 may have openings which define the areas between the sub-pixels. A stepper holds the pattern mask over the photoresist and the pattern image is projected onto the photoresist through a lens. The pattern is then imprinted onto the photoresist, for example, by hardening the portion of the photoresist that is exposed through the pattern mask, while the other (unexposed) portion of the photoresist remains relatively soft.

Alternatively, the portion of the photoresist exposed to the light becomes softer than the unexposed portion. The softer portion of the photoresist is then removed, leaving only the harder portion on the layer. Thus, in this manner, the pattern is reproduced in the photoresist on the surface of the layer. It is appreciated that this description applies to steps performed in the process of the present embodiment.

Referring still to FIG. 3B and to step 430 of FIG. 4, portions of photo-imageable lacquer layer 310 are exposed to light. The light may be e-beam, ultra-violet (UV) light, deep UV light, or another wavelength to which photo-imageable lacquer layer 310 reacts. In one embodiment, photo-imageable lacquer layer 310 can be a lacquer which softens when exposed to light (positive resist). The portions of photo-imageable lacquer layer 310 underlying the openings of pattern mask 340 correspond to the areas between the sub-pixels. When lacquer layer 310 is exposed, the areas between sub-pixel areas are now softened and the lacquer within sub-pixel areas 330 remains hardened.

In another embodiment, photo-imageable lacquer layer 310 can be a lacquer which crosslinks when exposed to light (negative resist). In this embodiment, pattern mask 340 has openings corresponding with sub-pixel areas 330. When lacquer layer 310 is exposed to light, the sub-pixel areas are now crosslinked and the lacquer between the sub-pixel areas 330 remains soluble.

With reference to FIG. 3C and to step 440 of FIG. 4, portions of photo-imageable lacquer layer 310 are removed. Photo-imageable lacquer layer is developed with a solvent such as methyl isobutyl ketone to remove the softer areas which were not underlying openings in pattern mask 340 and hardened during step 430 of FIG. 4. While methyl isobutyl ketone is recited in the present embodiment, the present invention is well suited to utilizing a variety solvents for this purpose. After developing photo-imageable lacquer layer 310, a selected portion of photo-imageable lacquer layer 310 remains deposited in sub-pixel area 330. Subsequently, an aluminum reflective layer is deposited upon photo-imageable lacquer layer 310 and faceplate 320 undergoes a second drying (e.g., baking) during which the remaining portion of photo-imageable lacquer layer 310 is removed as it can cause phosphor degradation if it remains in contact with phosphor particles 335.

The advantage of the present invention over the prior art is that photo-imageable lacquer 310 remains in the sub-pixel areas 330 and not on the rows and columns between the sub-pixel areas. The float lacquer process leaves a lacquer layer across the entire surface of faceplate 320, including the rows and columns. Tenting of a subsequently deposited aluminum layer is a frequent problem, particularly when lacquer is deposited in the rows and columns between sub-pixels when the faceplate is later baked to remove solvents from the sub-pixels. The present invention, by leaving photo-imageable lacquer layer 310 in the sub-pixel areas 330, is able to avoid this problem.

Figure 5A:
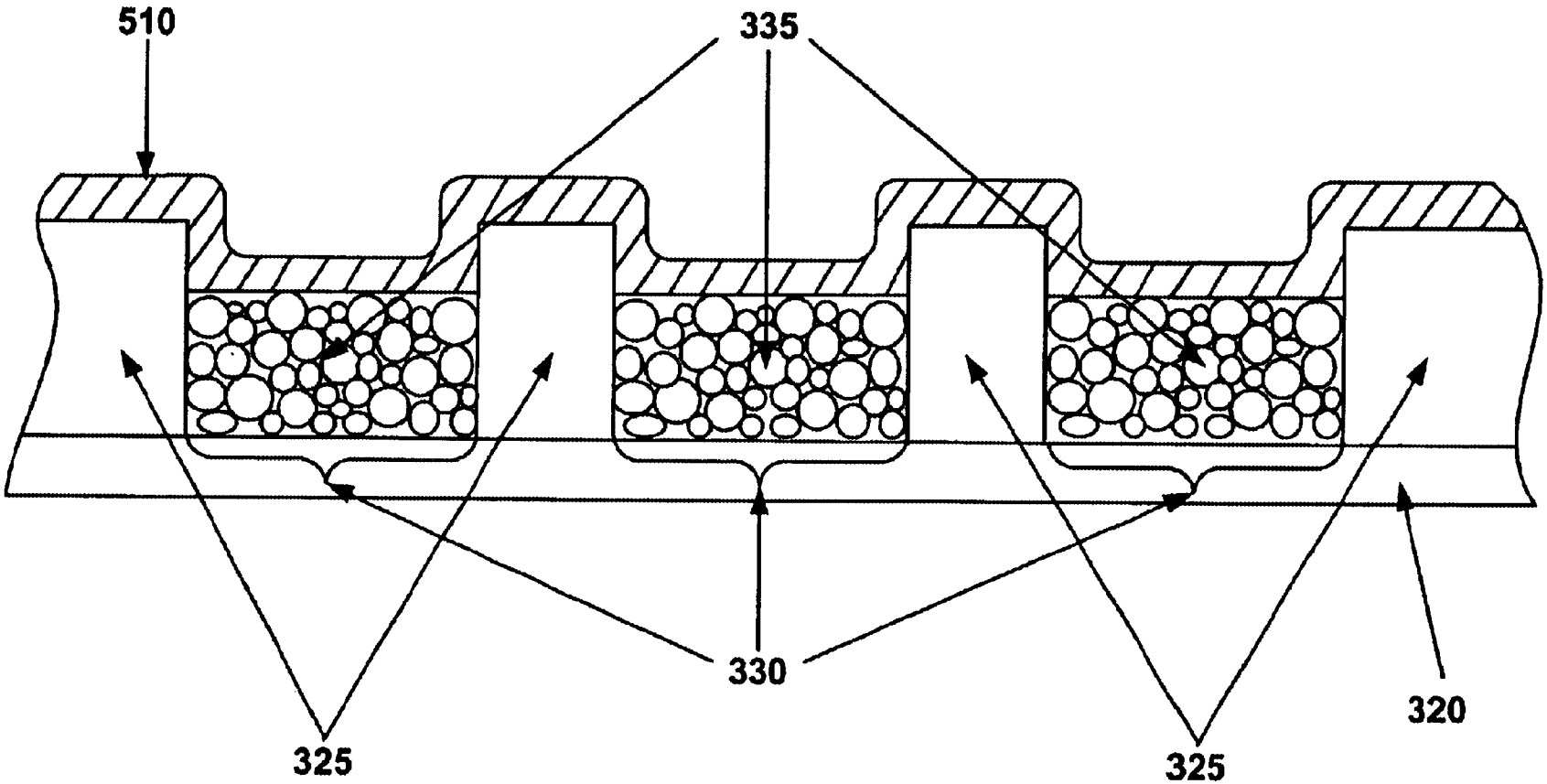
FIGS. 5A–5C are cross section views of a display pixel area during a lacquer layer deposition in accordance with embodiments of the present invention.
Figure 5B:
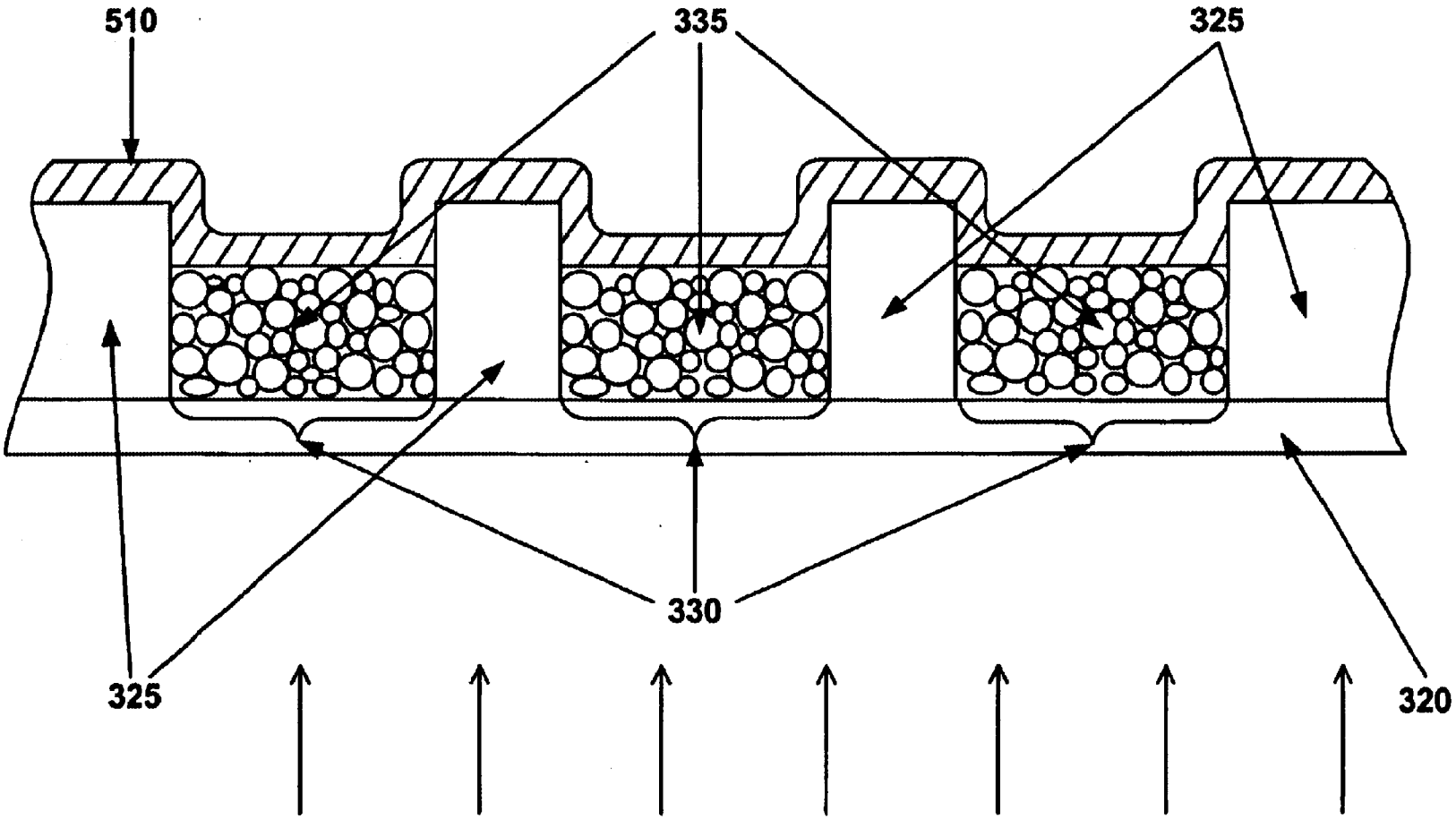
Figure 5C:
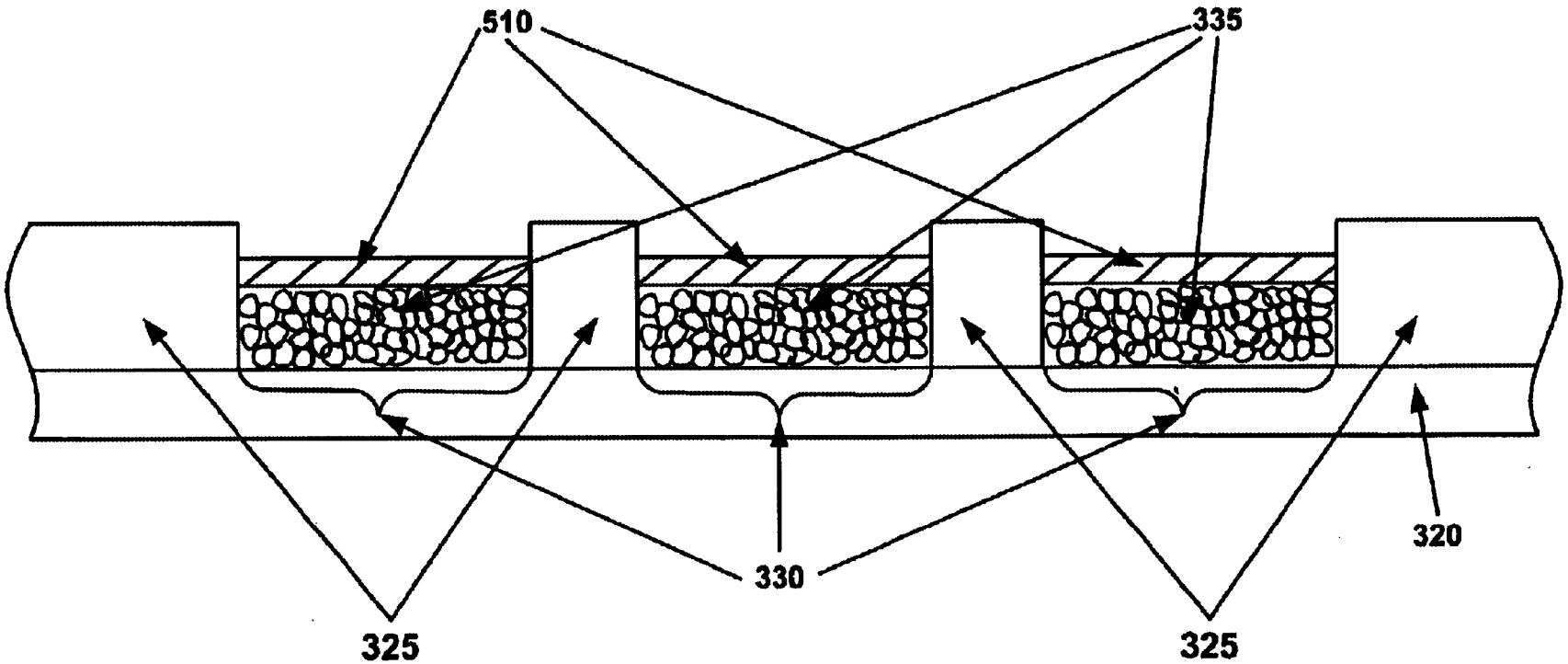
Figure 6:
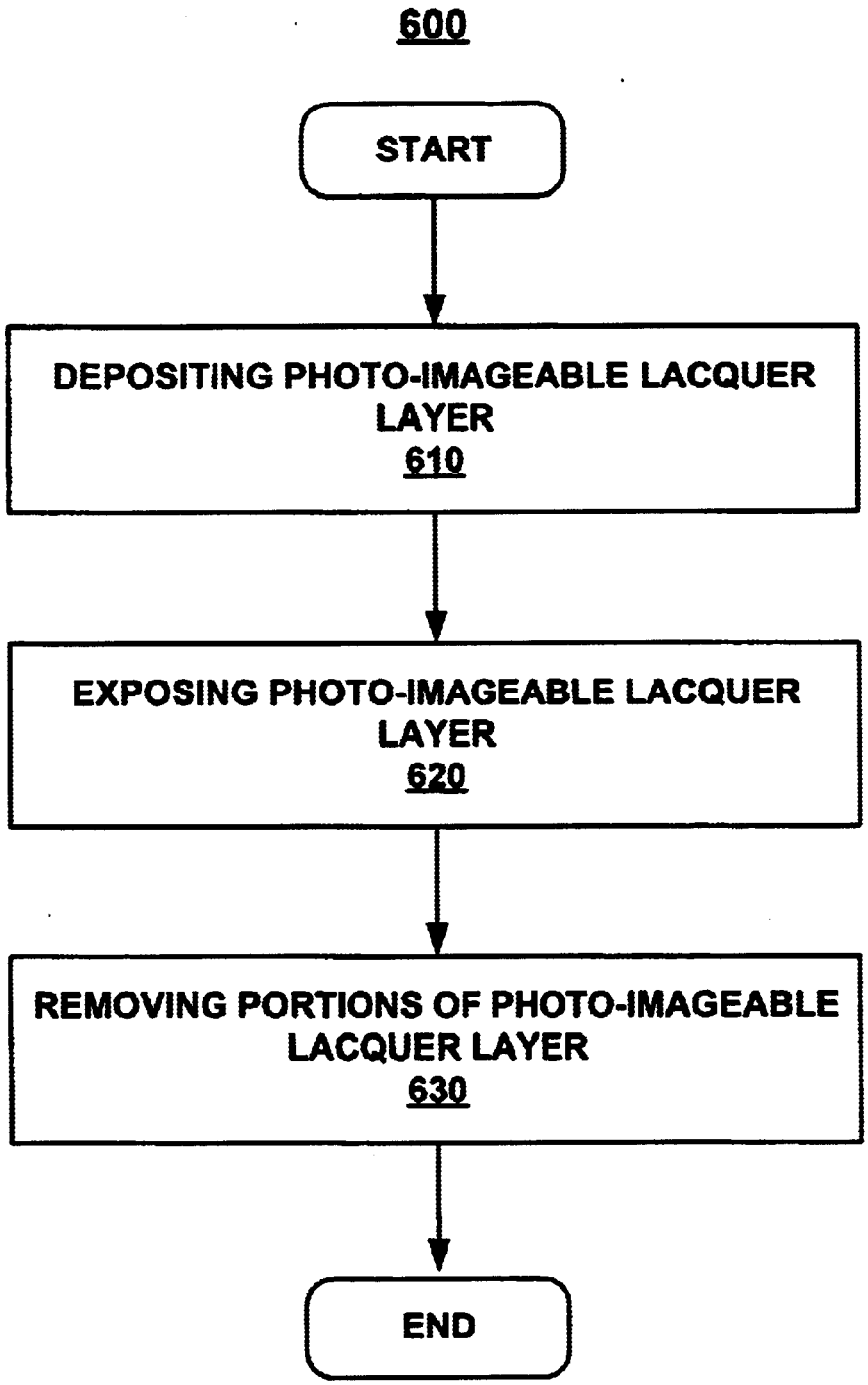
FIG. 6 is a flow chart of the steps involved in accordance with another embodiment of the present invention.

FIGS. 5A–5C are cross section views of a display pixel area during a lacquer layer deposition process as set forth in one embodiment of the current invention as set forth in flow chart 600 of FIG. 6. For purposes of clarity, the following discussion will utilize the cross section views of FIGS. 5A–5C in conjunction with flow chart 600 of FIG. 6, to clearly describe one embodiment of the present invention. As will be described in detail below, the present invention is a method for photo-imageable lacquer deposition for a display device.

With reference to FIG. 5A and to step 610 of FIG. 6, a photo-imageable lacquer layer 510 (a negative resist) is deposited. As in FIG. 3, photo-imageable lacquer layer 510 is deposited upon black matrix screen 325 having sub-pixel areas 330.

Again, the present invention does not use the float lacquer process which allows the use of low elongation lacquers. This allows the deposition of a lacquer layer which is less conformal to the phosphor particles in sub-pixel areas 330 and is not so thick as to cause tenting and bursting in the aluminum layer. This leads to a more uniform aluminum layer which reflects light to the phosphor particles more evenly and facilitates a brighter, more efficient display device.

Photo-imageable lacquer layer 510 may be deposited by spray deposition, spin deposition, printing, and extrusion. While the present embodiment recites these specific deposition methods, the present invention is well suited to utilize other methods to deposit photo-imageable lacquer layer 510. Photo-imageable lacquer layer 510 is deposited in a blanket deposition upon black matrix screen 325. After being deposited upon screen 325, photo-imageable lacquer layer 310 is dried.

Again, the present invention is much quicker than the float lacquer process and more suitable for large scale manufacturing processes. One of the greatest disadvantages of using a float lacquer process is that excessive time is lost in waiting for the water in the tank to become still and flat prior to depositing the lacquer layer. This makes the float lacquer process time consuming, uneconomical, and unsuited to large scale manufacturing processes. If the water is not allowed to become still, the lacquer layer will be of non-uniform thickness which can cause an irregular aluminum layer. Because photo-imageable lacquer layer 510 is not deposited using the float lacquer process, the present invention does not require this wait and is more applicable to large scale manufacturing processes.

With reference to FIG. 5B and to step 620 of FIG. 6, a negative resist photo-imageable lacquer layer 510 is exposed to light through faceplate 320 itself. Light will penetrate and/or scatter off of and around the phosphor particles to expose portions of photo-imageable lacquer layer 510. Additionally, the phosphor particles will also give off light in their respective spectrums. At the same time, the black matrix screen 325 serves as a pattern mask which prevents light from reaching portions of photo-imageable lacquer layer 510. In this embodiment, the present invention has the previously mentioned advantages over the prior art and eliminates the steps of creating a pattern mask (e.g., pattern mask 340 of FIG. 3) and aligning it over photo-imageable lacquer layer 510. Black matrix screen 325 now acts as the pattern mask, resulting in additional savings of time and money.

With reference to FIG. 5C and to step 630 of FIG. 6, portions of photo-imageable lacquer layer 510 are removed. Photo-imageable lacquer layer is developed with a solvent to remove the soluble areas which were not exposed to light in step 620. After developing photo-imageable lacquer layer 510, a selected portion of photo-imageable lacquer layer 510 remains in sub-pixel areas 330. The portions of photo-imageable lacquer layer 510 which were exposed to light remain in the sub-pixel areas 330, while those portions which were masked by black matrix screen 325 are removed. After this, an aluminum reflective layer is deposited upon photo-imageable lacquer layer 510 and faceplate 320 undergoes a second drying (e.g., baking). During the baking, remaining portions of photo-imageable lacquer layer 510 are removed as they will desorb gas due to electron impingement and destroy the vacuum and can cause phosphor degradation if they remain in contact with phosphor particles 335.

The present invention is a method for selectively removing a lacquer layer so that so that the remaining lacquer is disposed in the sub-pixel areas of a display device, resulting in a smooth, highly reflective aluminum layer that is electrically and mechanically robust. The present invention is also applicable to large scale manufacturing processes.

The preferred embodiment of the present invention, a method for photo-imageable lacquer deposition for a display device, is thus described. While the present invention has been described in particular embodiments, it should be appreciated that the present invention should not be construed as limited by such embodiments, but rather construed according to the following claims.

What is claimed is:

1. A method for depositing a lacquer layer for a display device comprising:

depositing a photo-imageable lacquer layer upon a faceplate of said display device; and removing a portion of said photo-imageable lacquer layer, where in a selected portion of said photo-imageable lacquer layer remains deposited within a sub-pixel area of said faceplate.

2. The method for depositing a lacquer layer for a display device as recited in claim 1, wherein said depositing further comprises depositing a layer of photo-imageable polymethyl methacrylate upon said faceplate.

3. The method for depositing a lacquer layer for a display device as recited in claim 1, wherein said depositing further comprises depositing said photo-imageable layer by a process selected from the group consisting of spray deposition, spin deposition, printing, and extrusion.

4. The method for depositing a lacquer layer for a display device as recited in claim 1, wherein said depositing further comprises drying said photo-imageable lacquer layer.

5. The method for depositing a lacquer layer for a display device as recited in claim 1, wherein said removing further comprises exposing said photo-imageable lacquer layer to light through a pattern mask.

6. The method for depositing a lacquer layer for a display device as recited in claim 5, wherein said removing further comprises:

creating said pattern mask, wherein said pattern mask has an opening defining said remaining portion of said photo-imageable lacquer layer;

aligning said pattern mask on top of said faceplate; and exposing said photo-imageable lacquer layer to said light through said pattern mask.

7. The method for depositing a lacquer layer for a display device as recited in claim 5, wherein said removing further comprises:

creating said pattern mask, wherein said pattern mask covers said remaining portion of said photo-imageable lacquer layer;

aligning said pattern mask on top of said faceplate; and exposing said photo-imageable lacquer layer to said light through said pattern mask.

8. The method for depositing a lacquer layer for a display device as recited in claim 5, wherein said removing further comprises developing said photo-imageable lacquer-layer with a solvent.

9. The method for depositing a lacquer layer for a display device as recited in claim 5, wherein said removing further comprises removing portions of said photo-imageable lacquer layer exposed to said light.

10. The method for depositing a lacquer layer for a display device as recited in claim 5, wherein said removing further comprises removing portions of said photo-imageable lacquer layer not exposed to said light.

11. The method for depositing a lacquer layer for a display device as recited in claim 1 wherein said method further comprises a second drying of said photo-imageable lacquer layer and wherein said photo-imageable lacquer layer is removed.

12. A method for depositing a lacquer layer for a display device comprising:

depositing a photo-imageable lacquer layer upon a faceplate of said display device;

aligning a pattern mask having an opening in an area not defined by a sub-pixel area above said photo-imageable lacquer layer and exposing an area underlying said opening to light; and removing a portion of said photo-imageable lacquer layer, wherein a selected portion of said photo-imageable lacquer layer underlying said opening remains deposited within a sub-pixel area of said faceplate.

13. The method for depositing a lacquer layer for a display device as recited in claim 12, wherein said depositing further comprises depositing a layer of polymethyl methacrylate upon said faceplate.

14. The method for depositing a lacquer layer for a display device as recited in claim 12, wherein said depositing further comprises depositing said photo-imageable layer by a process selected from the group consisting of spray deposition, spin deposition, printing, and extrusion.

15. The method for depositing a lacquer layer for a display device as recited in claim 12, wherein said depositing further comprises drying said photo-imageable lacquer layer.

16. The method for depositing a lacquer layer for a display device as recited in claim 12, wherein said light has a wavelength in the deep ultra violet portion of the spectrum.

17. The method for depositing a lacquer layer for a display device as recited in claim 12, wherein said removing further comprises developing said photo-imageable lacquer layer with a solvent.

18. The method for depositing a lacquer layer for a display device as recited in claim 12, wherein said method further comprises a second drying of said photo-imageable lacquer layer and wherein said photo-imageable lacquer layer is removed.

19. A method for depositing a lacquer layer for a display device comprising:

depositing a photo-imageable negative resist type lacquer layer upon a faceplate of said display device;

exposing said photo-imageable negative resist type lacquer layer to light through said faceplate; and removing portions of said photo-imageable negative resist type lacquer layer not subjected to said exposing, wherein a portion of said photo-imageable negative resist type lacquer layer remains deposited within a sub-pixel area of said faceplate.

20. The method for depositing a lacquer layer for a display device as recited in claim 19, wherein said depositing further comprises depositing said photo-imageable negative resist type lacquer layer by a process selected from the group consisting of spray deposition, spin deposition, printing, and extrusion.

21. The method for depositing a lacquer layer for a display device as recited in claim 19, wherein said depositing further comprises drying said photo-imageable negative resist type lacquer layer.

22. The method for depositing a lacquer layer for a display device as recited in claim 19, wherein said removing further comprises developing said photo-imageable negative resist type lacquer layer with a solvent.

23. The method for depositing a lacquer layer for a display device as recited in claim 19, wherein said method further comprises a second drying of said photo-imageable negative resist type lacquer layer and wherein said photo-imageable negative resist type lacquer layer is removed.

* * * * *